US007626890B2

(12) United States Patent
Fleming

(10) Patent No.: US 7,626,890 B2
(45) Date of Patent: Dec. 1, 2009

(54) HYBRID-DRIVE MULTI-MODE PIPE PROJECTOR

(75) Inventor: Richard A. G. Fleming, Ottawa (CA)

(73) Assignee: Her Majesty the Queen in right of Canada, as represented by the Minister of National Defence of Her Majesty's Canadian Government, Ottawa (CA)

( * ) Notice: Subject to any disclaimer, the term of this patent is extended or adjusted under 35 U.S.C. 154(b) by 93 days.

(21) Appl. No.: 11/979,675

(22) Filed: Nov. 7, 2007

(65) Prior Publication Data

US 2009/0116341 A1 May 7, 2009

(51) Int. Cl.
*H04R 17/00* (2006.01)

(52) U.S. Cl. ..... 367/176; 367/155; 367/156

(58) Field of Classification Search ..... 367/176, 367/168, 156, 155; 181/113
See application file for complete search history.

(56) References Cited

U.S. PATENT DOCUMENTS

| | | | | |
|---|---|---|---|---|
| 2,776,416 | A * | 1/1957 | Harris | 367/168 |
| 2,776,417 | A * | 1/1957 | Harris | 367/168 |
| 3,633,424 | A | 1/1972 | Lynnworth et al | |
| 4,766,357 | A | 8/1988 | Glomb | |
| 5,047,683 | A | 9/1991 | Butler | |
| 5,068,566 | A | 11/1991 | Culp | |
| 6,150,751 | A | 11/2000 | Burov | |
| 6,584,039 | B1 | 6/2003 | Purcell | |
| 6,792,798 | B2 | 9/2004 | Lian | |
| 6,950,373 | B2 | 9/2005 | Butler | |
| 6,998,999 | B2 | 2/2006 | Fripp | |
| 2009/0116341 | A1 * | 5/2009 | Fleming | 367/176 |

FOREIGN PATENT DOCUMENTS

| | | |
|---|---|---|
| CA | 1065046 | 10/1979 |
| RU | 2253191 | 5/2005 |

OTHER PUBLICATIONS

Baker, Solid State High Voltage Power Supply, Thordis Corporation, Abstract, 1 pg.

* cited by examiner

*Primary Examiner*—Dan Pihulic
(74) *Attorney, Agent, or Firm*—Jones, Tullar & Cooper, P.C.

(57) ABSTRACT

A hybrid drive (HD) multi-mode pipe projector (MMPP) for use in underwater acoustic applications is provided. The HD MMPP is formed with an inner magnetostrictive drive motor nested within an outer drive motor. The inner motor is surrounded by a magnetic field generating coil winding. Preferably the inner drive motor is a Terfenol-D motor and the outer drive motor is a radially-poled piezoceramic drive motor. This nested configuration provides increased bandwidth and low-frequency extension to the MMPP design.

12 Claims, 4 Drawing Sheets

HYBRID-DRIVE MULTI-MODE PIPE PROJECTOR

TECHNICAL FIELD

The present device relates to an acoustic projector, particularly a multi-mode pipe projector (MMPP) having an increased bandwidth and enhanced low frequency operation.

BACKGROUND

The MMPP was invented at Defence Research Development Canada (DRDC) Atlantic in response to a need for high power, depth insensitive and wideband underwater sound projection from a single small device. By reversing the orientation of the endcaps of the Axial Drive Resonant Pipe Projector (ADRPP) and with computer optimization, the very wideband MMPP was developed. Since the MMPP only entrains air within its very stiff drive motor, it can operate to great depth without significant changes to its performance. As for bandwidth, some examples of the MMPP have greater than 3 octaves of useable response and therefore can be used in a variety of applications. They are also useful in sonobuoys, torpedo countermeasures, acoustic hammers, mine recognition sonars, underwater positioning systems, and underwater loudspeakers for swimming pools. MMPP's are currently being used in underwater communications system and as acoustic modems and have shown utility as calibration sound sources.

An example of a multi-mode pipe projector (MMPP) is described in U.S. Pat. No. 6,584,039 B1 and illustrated in FIG. 1A. The MMPP has a pair of spaced apart end plates 2 with a twelve ring ceramic stack piezoelectric driver 4 positioned between and coupled to the end plates 2. The driver 4 has a smaller cross-section than the end plates 2. Tubular pipe waveguides 6 having open ends are attached to the end plates 2 and arranged to face each other. The driver 4 is sealed in a neoprene boot 8.

Current multi-mode pipe projector (MMPP) transducers have limited low frequency capability due to the low strain nature of their piezoceramic drive motors and their small size as compared to wavelength of operation. The Terfenol-D magnetostrictive version of the MMPP can operate at a lower frequency than others; however it has limited high frequency capability due to a lack of drive motor breathing modes inherent in piezoceramically driven MMPP's and due to high frequency eddy current-induced losses. Terfenol-D is a magnetostrictive alloy made of terbium, dysprosium and iron metals.

FIG. 1B shows a typical mid-frequency MMPP. The size of such a compact device is approximately 4 inches in diameter and 7 inches long. In order to expand the bandwidth of the MMPP and provide extreme bandwidth coverage with low frequency extension, multiple transducers are required, which take up more space than a single transducer.

SUMMARY

The present device attempts to overcome the deficiencies noted in the prior art above. An MMPP transducer is formed by nesting a Terfenol-D magnetostrictive drive motor within a radially-poled piezoceramic drive motor, an arrangement which will be referred to as a hybrid-drive (HD) MMPP. The Terfenol-D inner motor is surrounded by a magnetic field generating coil winding. It has been found that this parallel configuration of piezoceramic and magnetostrictive drive motors provides increased bandwidth and low-frequency extension to the MMPP design.

In accordance with one embodiment there is provided an acoustic projector having a pair of spaced apart tubular pipe waveguides, each waveguide extending inwards and surrounding opposing end portions of the projector, the acoustic projector comprising: a piezoceramic outer drive motor extending longitudinally between the waveguides, the outer drive motor having a smaller cross-sectional dimension than the waveguides; and a magnetostrictive inner drive motor nested within the outer drive motor and extending longitudinally between the two waveguides.

BRIEF DESCRIPTION OF THE DRAWINGS

The following description will be better understood with reference to the drawings in which.

DESCRIPTION OF THE PREFERRED EMBODIMENTS

Figure 2:
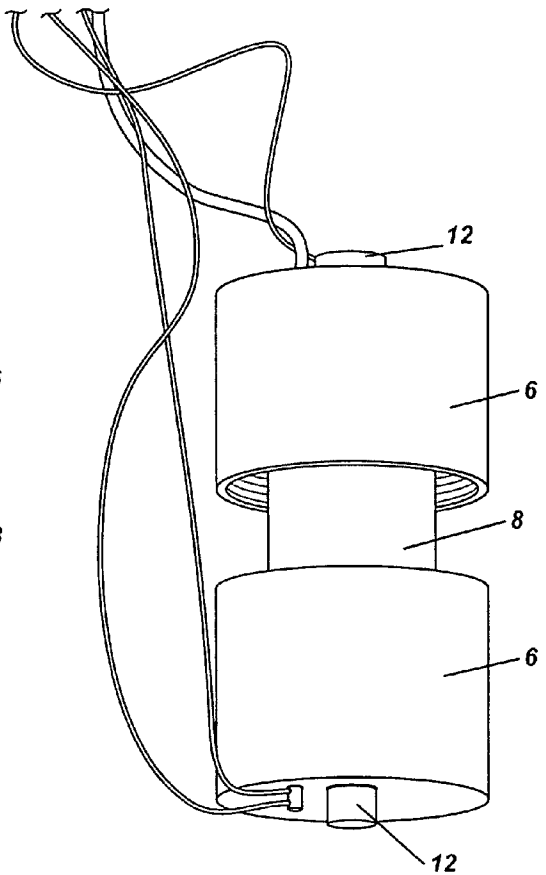
FIG. 2 shows a perspective view of a hybrid-drive MMPP in accordance with the present device.
Figure 1B:
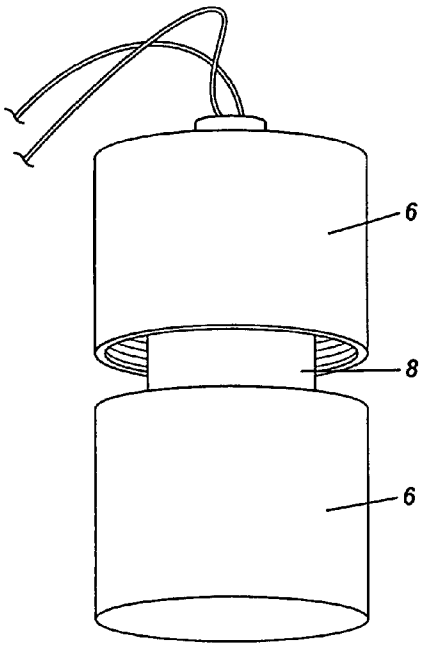
FIG. 1B Prior Art
FIG. 1B shows a perspective view of a prior art mid-frequency MMPP.

In the embodiment shown in FIG. 2, a neoprene boot 8 surrounds the acoustic drive motors. Within the neoprene boot 8 a Terfenol-D magnetostrictive drive motor is nested within a radially-poled and driven piezoceramic drive motor. Both motors can be operated electrically and mechanically in parallel, in series or independently.

Figure 1A:
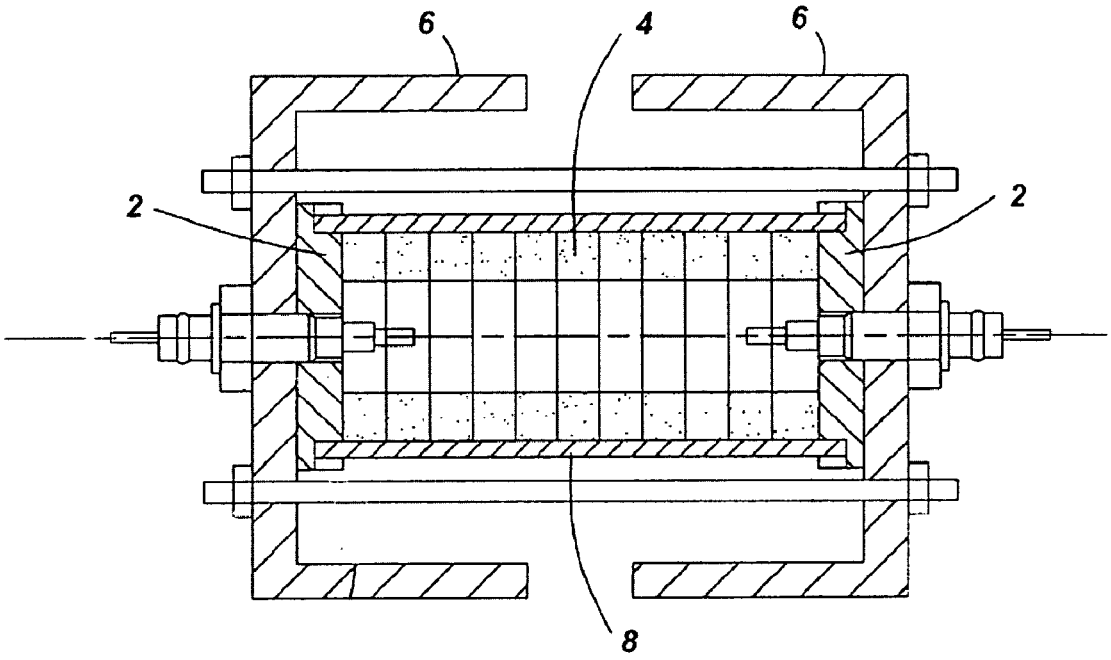
Figure 1A Prior Art
FIG. 1A shows a cross-sectional view of a prior art MMPP.
Figure 3:
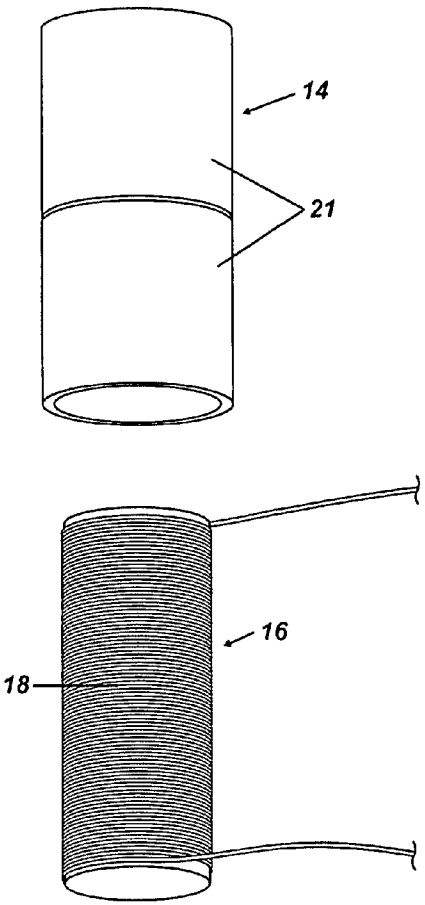
FIG. 3 shows a radially poled piezoceramic outer drive motor and a Terfenol-D inner drive motor with magnetic field generating coil winding.

FIG. 3 shows the radially poled piezoceramic outer drive motor 14 and a Terfenol-D inner drive motor 16 surrounded by magnetic field generating coil windings 18.

Figure 4:
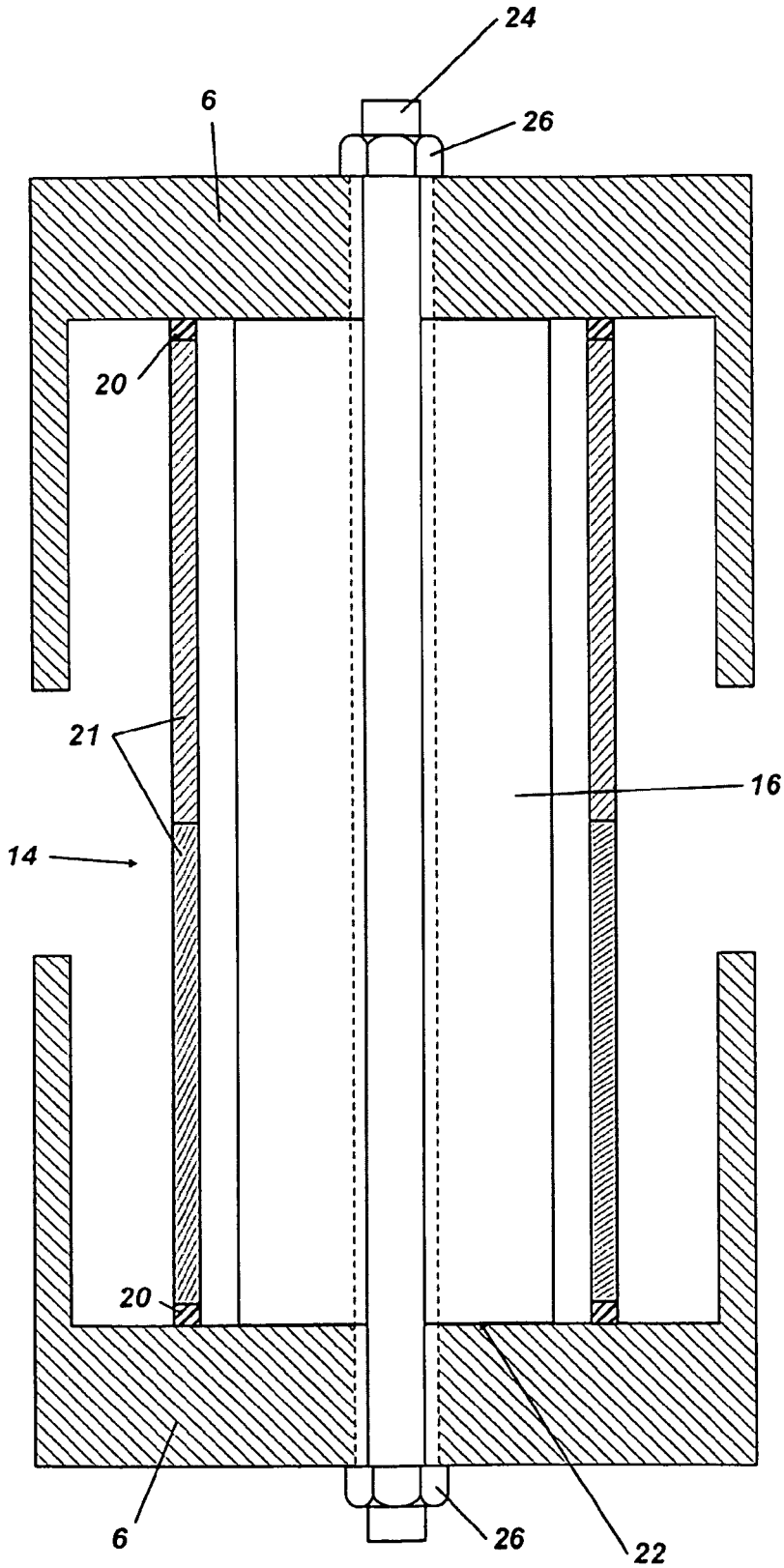
FIG. 4 shows a cross-sectional representative view of the HD MMPP.

FIG. 4 shows a representative cross-sectional view of the HD MMPP. The cylindrical piezoceramic motor 14 is resiliently mounted while the magnetostrictive motor 16 is rigidly mounted to prevent tensile failure of the piezoceramic motor 14. A resilient rubber ring 20 separates the piezoceramic cylinders 21 from the waveguides 6. Also, the joint 22 between the Terfenol-D motor 16 and the waveguides 6 is solid, perferably formed with epoxy. A prestress rod 24 extends axially through the center. Nuts 26 are threaded onto the ends of the prestress rod 24 to apply a compressive force to the structure.

Figure 5:
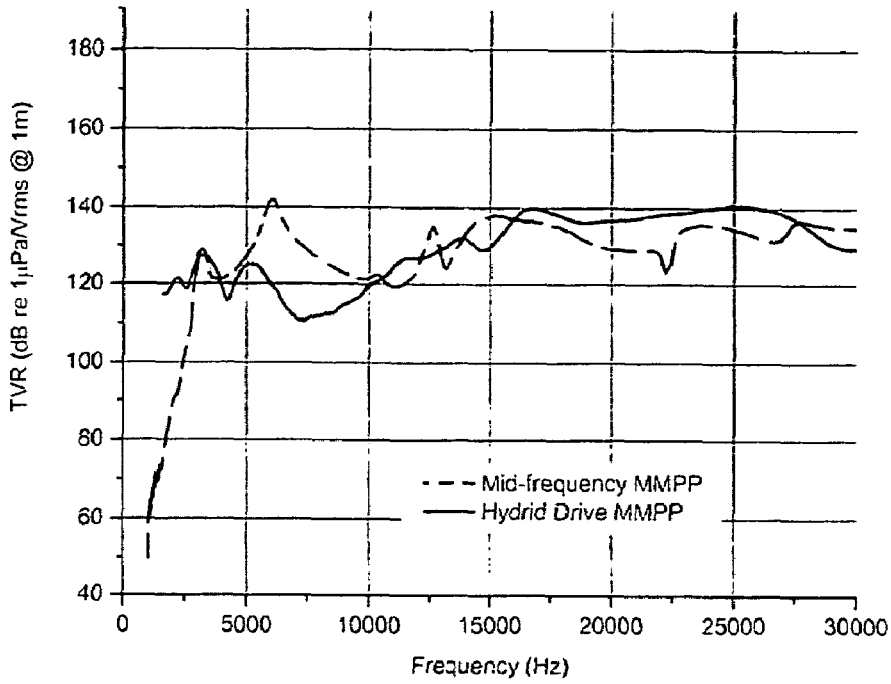
FIG. 5 shows a comparison of TVR's (transmitting voltage response) of the HD MMPP and a mid-frequency MMPP.

A prototype of the HD MMPP has shown extended bandwidth and enhanced low frequency performance over existing single-motored MMPP's of similar size in tests comparing the prototype HD MMPP and a mid-frequency MMPP having the same size. FIG. 5 shows the results of these tests wherein it can be seen that the HD MMPP has extended low frequency operation while still permitting drive stack breathing mode operation for high frequency operation. Accordingly, the HD MMPP shows both enhanced low frequency performance as well as a wide bandwidth.

The radial breathing mode of operation of the piezoceramic drive motor is the fundamental high frequency method for sound generation for MMPP's in general. The HD MMPP's piezoceramic cylinders are poled through their radial dimension and therefore their preferred motion is in the radial direction. This motion couples well to the fluid entrained in the volume within the waveguides. In FIG. 5, only the output below 8.2 kHz is due to the Terfenol-D motor whereas above 8.2 kHz, the piezoceramic cylinders predominate.

Figure 6:
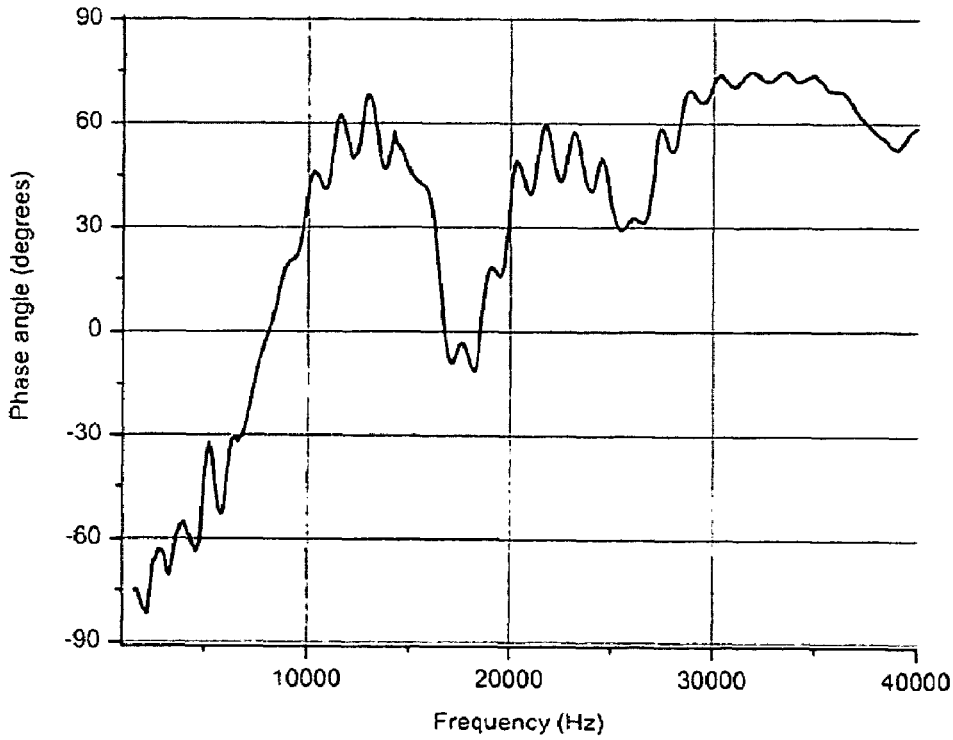
FIG. 6 shows the electrical phase of the HD MMPP as a function of frequency.

As an added benefit of the configuration of the HD MMPP, the parallel and nested motors form a first-order filter network for effective crossover of signals to the appropriate motor (8200 Hz for the prototype) and controlled by coil inductance and piezocerarnic capacitance. FIG. 6 shows the electrical phase of the HD MMPP as a function of frequency. At 8200 Hz, the electrical phase can be seen as passing through zero degrees (therefore the device is purely resistive at this frequency). The HD MMPP may be considered as self-tuning, especially near the frequency where the capacitive and inductive reactances are equal. This frequency is optimized in the design process by selecting appropriate piezoceramic drive motor capacitance and Terfenol-D coil inductance.

Variations of the device will be appreciated by a person of skill in the art. For example, it is preferable to use a Terfenol-D inner drive motor and piezoceramic outer drive motor, but other combinations and forms of magnetostrictive drive motors may be used. The device can be operated in series, parallel or each motor can be operated on its own. The example performance shown in FIGS. 5 and 6 is for parallel operation.

What is claimed is:

1. An acoustic projector having a pair of spaced apart tubular pipe waveguides, each waveguide extending inwards and surrounding opposing end portions of the projector, the acoustic projector comprising:

a piezoceramic outer drive motor extending longitudinally between the waveguides, the outer drive motor having a smaller cross-sectional dimension than the waveguides; and a magnetostrictive inner drive motor nested within the outer drive motor and extending longitudinally between the two waveguides.

2. The acoustic projector of claim 1 wherein the outer drive motor is mounted resiliently to the endcaps and the inner drive motor is mounted rigidly to the end caps.

3. The acoustic projector of claim 2 wherein the inner drive motor is surrounded by a magnetic field generating coil winding.

4. The acoustic projector of claim 3 wherein the piezoceramic outer drive motor is a radially poled piezoceramic drive motor.

5. The acoustic projector of claim 4 wherein the inner drive motor is a terbium dysprosium iron magnetostrictive alloy drive motor.

6. The acoustic projector of claim 2 further comprising a rubber ring separating the outer drive motor from each waveguide.

7. The acoustic projector of claim 2 wherein the inner drive motor is attached to the waveguides with epoxy.

8. The acoustic projector of claim 1 further comprising a prestress rod extending longitudinally through the inner drive motor and through the waveguides, and a nut threaded onto each end of the prestress rod.

9. The acoustic projector of claim 1 wherein the acoustic projector has a wide bandwidth and is operable at low frequencies.

10. The acoustic projector of claim 1 wherein the inner and outer motors are operated electrically and mechanically in parallel.

11. The acoustic projector of claim 1 wherein the inner and outer motors are operated electrically and mechanically in series.

12. The acoustic projector of claim 1 wherein the inner drive motor and outer drive motor are operated independently.

* * * * *